US005599124A

United States Patent [19]

Ackermann et al.

[11] Patent Number: 5,599,124

[45] Date of Patent: Feb. 4, 1997

[54] SNAP-TOGETHER LIPSTICK BASE AND CARTRIDGE HAVING SNAP LOCKING MEANS

[75] Inventors: Walter T. Ackermann, Watertown; Thomas F. Holloway, Southbury, both of Conn.

[73] Assignee: Risdon Corporation, Naugatuck, Conn.

[21] Appl. No.: 546,417

[22] Filed: Oct. 20, 1995

[51] Int. Cl.[6] ..... A45D 40/06

[52] U.S. Cl. ..... 401/78; 401/86; 401/87

[58] Field of Search ..... 401/78, 86, 87

[56] References Cited

U.S. PATENT DOCUMENTS 2,815,123 12/1957 Safianoff ..... 401/87

4,505,607 3/1985 Sugiyama ..... 401/78

5,340,225 8/1994 Chevassus ..... 401/78

FOREIGN PATENT DOCUMENTS 4206299 9/1993 Germany ..... 401/87

*Primary Examiner*—Steven A. Bratlie

*Attorney, Agent, or Firm*—Dallett Hoopes

[57] ABSTRACT

A lipstick comprising a cartridge and a base wherein the base is formed with upward latches which snap barb fashion over an annular shoulder in the lower end of the inner of the cartridge. The pomade cup has a downward projection to hold the latches outward. Specifically, the cup has a downward "stovepipe" which, when the cup is retracted, fits inside the latches to prevent them from springing inward on impact and releasing the cartridge.

2 Claims, 2 Drawing Sheets

SNAP-TOGETHER LIPSTICK BASE AND CARTRIDGE HAVING SNAP LOCKING MEANS

FIELD OF THE INVENTION

This invention relates to a screw-type lipstick container comprising a snap-together base and cartridge. More specifically, this invention relates to means for locking the snap fastener structure engaged so that it does not fail when the lipstick is dropped and impacts on landing.

BACKGROUND OF THE INVENTION

One method of manufacture of top-of-the-line lipsticks involves making the lipstick container in two connected parts: an ornamented base and a tubular cartridge assembly held together by a barb- or latch-type joint. This is a more secure method than the more conventional systems, such as press fits or hot-melt adhesive. In addition, the barb-type joint is well suited to the realities of economy and logistics: it is sometimes desirable to ship the lipstick to another location from the manufacturer so that it can there be filled with the molded pomade. After filling, the cartridge can be sent back to the manufacturer. In making the lipstick container in two parts, base and cartridge, the cartridge can be shipped to the filler separately without the base, thus saving shipping costs and container space. The final snap assembly of the base and cartridge can be done when the unit is received back at the manufacturer after filling. The cover is also applied.

It has been the experience in the industry that these expensive lipsticks have occasionally, when dropped, failed at the barb-type fastener on impact so that the cartridge comes loose and slams against the top of the cover and the pomade breaks free from its cup and is damaged beyond use. As a precaution against such failure, the industry now demands a testing program for such lipstick containers. This test involves the intentional dropping of the lipsticks with cover on and pomade down from a height of several feet onto a solid surface. Such testing is now routine.

To satisfy the customer and, incidentally, to pass this stringent test, the Applicant has investigated the cause of such failure in the past. After this careful investigation it has been confirmed that the separation of the cartridge and the base has invariably been caused by the failure of the barb latches which hold the two parts together. Often these latches are in the form of a pair of cantilevered hooked spring latches formed unitarily with the molded plastic base. The hooks, facing outward, engage in assembly over the top of an annular upward shoulder in the lipstick innerbody or "inner".

In the impact of the drop test, the downwardly falling lipstick experiences an immediate stop as it lands. The cartridge with its pomade, having some mass, and having built up velocity in the fall, wants to continue the travel. The result is that there is stress on the snap fastener structure which induces disengagement.

The purpose of the present invention, therefore, is to present means for assuring that the latches described above do not disengage from the inner in such a fall.

SUMMARY OF THE INVENTION

The invention pertains to a lipstick comprising a cartridge and a base wherein the base is formed with an upward tubular core having cantilevered latches which hook snap-fastener-fashion over an annular shoulder in the lower end of the inner-body. The invention provides means to hold the latches outward in engagement with the shoulder. Specifically, the means is in the form of a downward inner annular wall, or "stovepipe", on the cup which, when the cup is retracted—which it invariably is when the lipstick is undergoing the impact—fits inbetween the two outward cantilevered latches to prevent and lock them from springing inward on impact and releasing the cartridge.

BRIEF DESCRIPTION OF THE DRAWINGS

Further objects and features of the invention will be apparent to those skilled in the art from a study of the following specification and the accompanying drawings, all of which disclose a non-limiting embodiment of the invention. In the drawings.

DESCRIPTION OF THE PREFERRED EMBODIMENTS

Figure 1:
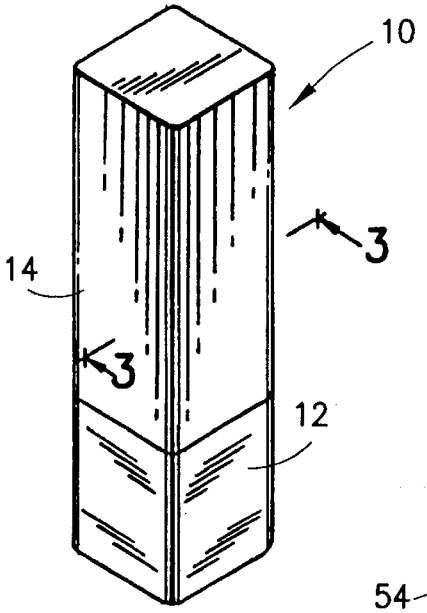
FIG. 1 is a perspective view of a lipstick embodying the invention.

A lipstick embodying the invention is shown in FIG. 1 and generally designated 10. It comprises a base 12 and a cover 14. The base (FIG. 3) comprises an outer housing 15 and a plastic plug 16 having a generally square bottom portion including a transverse wall 18 and a downward peripheral wall 20.

Figure 2:
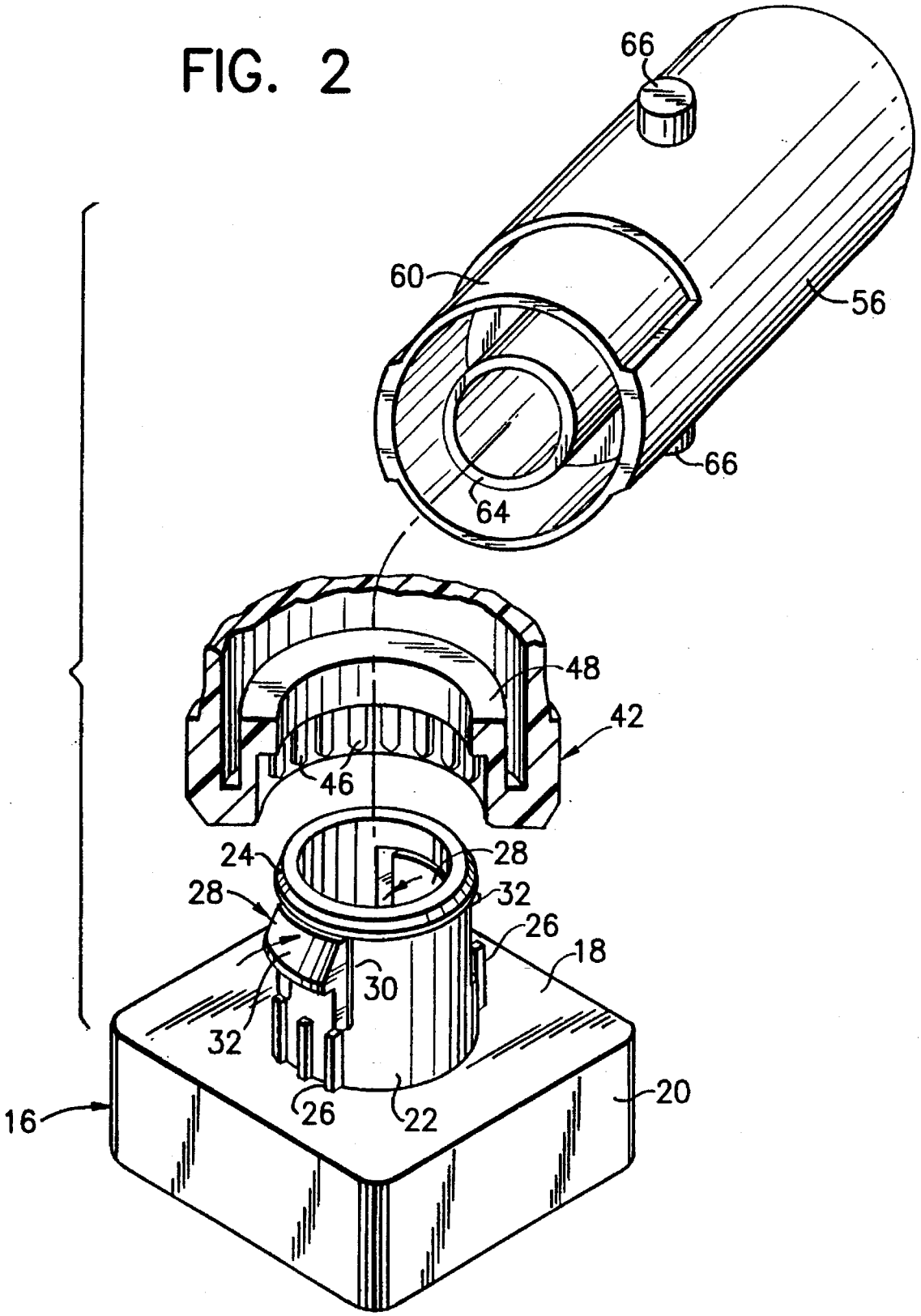
FIG. 2 is a greatly enlarged exploded view of parts of the lipstick. The inner is shown fragmentary fashion.

From the center of the wall 18 plug 16 has an annular upward tubular core 22 which has a lead-in bevel 24 at its upper end. Adjacent the wall 18 the tubular core is formed with upward spaced ridges 26. As best shown in FIG. 2, above the ridges 26 the tubular core 22 is formed with cantilevered spring latches 28. These latches are integral with the core at their lower ends but are spaced away from the core at their upward ends and along their sides as at 30. The latches are each formed with outward hooks 32 which provide a latching function, the hooks having downwardly and outwardly inclined upper ends.

The base housing 15 (FIG. 3) is formed with a liner 36 secured to the inside surface thereof. The lower end of the liner 36 is reduced inwardly as at 38 and has cemented thereto the peripheral wall 20 of the plug.

Figure 3:
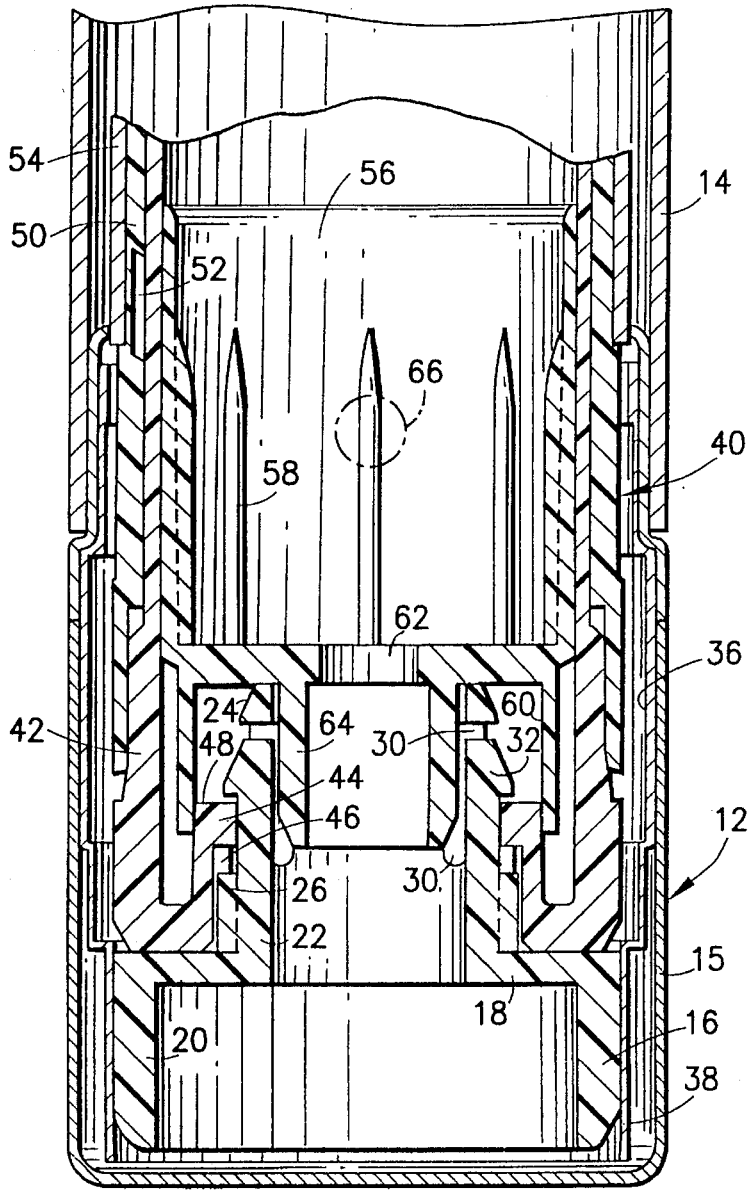
FIG. 3 is a sectional view taken on the line 3—3 of FIG. 1.

The lipstick also comprises a cartridge generally designated 40 (FIG. 3). The cartridge includes a tubular inner 42 having longitudinal slots (not shown) as is conventional. It is formed at its lower end with a tubular re-entrant portion 44 having at its mouth spaced ribs 46 (FIG. 2) which interfit with the ridges 26 so that the base and inner 42 turn in unison. The upper end of the re-entrant portion is enlarged and presents an annular upwardly facing shoulder 48.

Closely surrounding the slotted tubular inner is the cam 50 which has a spiral groove 52 as is conventional. A metal decorative shell 54 snugly encloses the cam so as no be turnable therewith. The pomade cup 56, slidable inside the inner, may be formed with inward flutings 58 to enhance the security of the pomade (not shown) in the cup. The cup includes the downward outer annular wall 60 which extends down to help guide the descending cup as the wall telescopes over the re-entrant portion 44 at the bottom of its travel. The cup is formed with a central vent or filling opening 62.

The cup further comprises the outward lugs 66 (FIG. 2) which are conventional and which are received in assembly of the cartridge through the slots of the inner 42 and terminate in the spiral grooves 52 of the cam 50. Thus, as is conventional, when the inner is turned relative to the cam and shell 50, 54, the cup 56 is extended or retracted.

Finally, an essential element of the invention, is a downward annular inner wall 64 unitary with the cup and which may have a beveled lead-in as shown (FIG. 2). The diameter of the inner annular wall 64 or "stovepipe" is slightly smaller than the inner diameter of the tubular core 22.

In the assembly of the cartridge to the base, the lower end of the cartridge 40 with the filled pomade cup elevated in the inner, is introduced into the opening at the top of the base 12 so that the lower end of the inner 42 extends down into the base and the upper end of the re-entrant portion engages the hooks 32 of the latches 28. The cartridge is then pushed "home" and the latches 28 deflect inwardly to allow the re-entrant diameter to slip past the latch hooks whereupon the latches snap outward, over shoulder 48 to hold the cartridge onto the base. At this point, of course, the ridges 26 interdigitate with the ribs 46 on the inner so that the aforesaid unifying for turning is effected.

In final assembly the shell 54 is grasped by one hand and the base 12 held by the other hand. The two are relatively rotated, fully retracting the cup 56 so that the "stovepipe" 64 slides into the interior of the tubular core 22 to the position shown in FIG. 3.

As will be noted, with the cup fully retracted, the "stovepipe" 64 blocks the inward deflection of the latches 28 so that the latches are blocked from releasing. Thus, by the addition of the annular wall 64 or "stovepipe", the latches 28 are held in permanent engagement. By this relatively small structural change, the customer will not experience the frustration of having the lipstick ruined when it accidentally drops. Further, of course, the units described will surely pass the industry "drop test".

The invention described here may take a number of forms. It is not limited to the embodiment disclosed but is of a scope defined by the following claim language which may be broadened by an extension of the right to exclude others from making, using or selling the invention as is appropriate under the doctrine of equivalents.

What is claimed is:

1. In a lipstick comprising:

a. a cartridge including a tubular inner formed with a longitudinal slot therein and having at its lower end an inward annular wall with an upward tubular socket wall terminating in an annular upwardly facing shoulder, a tubular cam immediately outside the inner and having an internal spiral track therein, and a pomade cup formed with a floor and upward and downward side walls from the floor and having an outward lug fitting through the longitudinal slot and into the spiral track, b. a base defined by a plug having a transverse wall and a tubular core extending upward centrally from the wall, the core being received into the lower end of the tubular socket wall of the inner, the core having a head with portions cut away to define cantilevered latches extending upward, the lower ends of the latches being unitary with the core and the upper ends being normally adapted to flex inward and having outward hooks thereon adapted to snappingly engage over the shoulder on the inner, the improvement wherein the pomade cup has a downward inner annular wall which is received into the head of the core when the cup is retracted and the downward side wall of the cup and the downward inner annular wall closely laterally confine the head of the core and the tubular socket wall to keep the latches engaged with the shoulder.

2. A lipstick as claimed in claim 1 wherein the inner annular wall is formed with a bevelled lead-in on the outer edge of its distal end.

* * * * *